US007491255B2

(12) United States Patent
Jung

(10) Patent No.: US 7,491,255 B2
(45) Date of Patent: Feb. 17, 2009

(54) DUST COLLECTION UNIT FOR VACUUM CLEANER

(75) Inventor: Jae Duk Jung, Changwon-si (KR)

(73) Assignee: LG Electronics Inc., Seoul (KR)

( * ) Notice: Subject to any disclaimer, the term of this patent is extended or adjusted under 35 U.S.C. 154(b) by 546 days.

(21) Appl. No.: 11/232,857

(22) Filed: Sep. 23, 2005

(65) Prior Publication Data

US 2006/0137305 A1 Jun. 29, 2006

(30) Foreign Application Priority Data

Dec. 27, 2004 (KR) ..... 10-2004-0113397

(51) Int. Cl.
*B01D 45/12* (2006.01)

(52) U.S. Cl. ..... 55/343; 55/349; 55/418; 55/429; 55/DIG. 3

(58) Field of Classification Search ..... 55/343, 55/345, 346, 349, 418, 426, 429, DIG. 3
See application file for complete search history.

(56) References Cited

U.S. PATENT DOCUMENTS 6,835,222 B2 * 12/2004 Gammack ..... 55/345
2004/0194250 A1 10/2004 Conrad et al.

FOREIGN PATENT DOCUMENTS

| | | |
|---|---|---|
| FR | 2 865 917 | 8/2004 |
| GB | 2 360 719 | 10/2001 |
| GB | 2 360 719 A | 10/2001 |
| GB | 2 399 780 A | 9/2004 |
| JP | 52-14775 | 2/1977 |
| RU | 2 237 424 C2 | 10/2004 |
| WO | WO 02/069778 | 9/2002 |

* cited by examiner

*Primary Examiner*—Robert A Hopkins
(74) *Attorney, Agent, or Firm*—McKenna Long & Aldridge LLP

(57) ABSTRACT

Provided is a dust collection unit for a vacuum cleaner that can provide an improved collection efficiency, a reduced reduce, and a good outer appearance. The dust collection unit includes: a first filtering chamber for filtering first foreign objects; a plurality of second filtering chambers formed along an outer circumference of the first filtering chamber to receive air passed through the first filtering chamber and filter second foreign objects by using cyclone airflow, the second foreign objects being smaller than the first foreign objects; an air intake hole through which air is introduced into the second filtering chambers; at least one air introduction guide extended outward from the air intake hole to guide a flow of air introduced into the second filtering chamber; and a storing chamber formed under the filtering chamber.

20 Claims, 9 Drawing Sheets

DUST COLLECTION UNIT FOR VACUUM CLEANER

BACKGROUND OF THE INVENTION

1. Field of the Invention

The present invention relates to a dust collection unit for a vacuum cleaner, and more particularly, to a dust collection unit for a vacuum cleaner, which has an improved internal structure of a cyclone dust collection unit where foreign objects are collected, thereby reducing an airflow resistance and noise and improving an outer appearance of the dust collection unit.

2. Description of the Related Art

A vacuum cleaner is used to clean a room or other spaces by sucking air containing foreign objects and filtering the foreign object using vacuum pressure generated therein. In order to filter the foreign objects contained in the sucked air, a dust collection unit is provided in the vacuum cleaner and a filter designed with a predetermined structure is provided in the dust collection unit.

The typical filter is formed of porous material so that the foreign objects are filtered while the air containing the foreign objects passes through the filter. However, since it is inconvenient to reuse the filter formed of the porous material and it is difficult to clean the filter, in recent years, a cyclone unit has been widely used. However, the cyclone unit has a problem in that it cannot filter micro-scale foreign objects. Therefore, an additional porous filter formed of the porous material has been associated with the cyclone unit.

However, when the porous filter is combined with the cyclone unit, the problem of periodically cleaning the filter still remains. When the foreign objects are implanted in the porous filter, an airflow rate is reduced, thereby deteriorating the operational efficiency of the vacuum cleaner.

To solve the above problems, in recent years, a multi-cyclone type dust collection unit has been developed. In the multi-cyclone type dust collection unit, the cyclone unit is provided in plurality so that the foreign objects contained in the air can be filtered by only the cyclone airflows. Since foreign objects are sufficiently filtered by a plurality of cyclone airflows, a filtering efficiency becomes much higher. Also, the porous filter need not be embedded separately, the user need not clean the filter separately.

However, in order to form a plurality of filtering chambers, a complicated airflow structure must be formed inside the multi-cyclone type dust collection unit. For this purpose, the airflow must be guided in an appropriate direction. Otherwise, noise and airflow resistance may increase and foreign objects may be collected inside the dust collection unit.

SUMMARY OF THE INVENTION

Accordingly, the present invention is directed to a dust collection unit for a vacuum cleaner that substantially obviates one or more problems due to limitations and disadvantages of the related art.

An object of the present invention is to provide a dust collection unit for a vacuum cleaner, which is capable of noise and airflow resistance generated during an operation of the dust collection unit.

Another object of the present invention is to provide a dust collection unit for a vacuum cleaner, which is capable of preventing air from being introduced through another airflow, so that foreign objects are not lumped, thereby preventing an outer appearance from being dirty.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dust collection unit for a vacuum cleaner, including: a first filtering chamber for filtering first foreign objects; a plurality of second filtering chambers formed along an outer circumference of the first filtering chamber to receive air passed through the first filtering chamber and filter second foreign objects by using cyclone airflow, the second foreign objects being smaller than the first foreign objects; an air intake hole through which air is introduced into the second filtering chambers; at least one air introduction guide extended outward from the air intake hole to guide a flow of air introduced into the second filtering chamber; and a storing chamber formed under the filtering chamber.

In another aspect of the present invention, there is provided a dust collection unit for a vacuum cleaner, including: a first filtering chamber for filtering a first foreign objects; a plurality of second filtering chambers formed along an outer circumference of the first filtering chamber to receive air passed through the first filtering chamber and filter a second foreign objects by using cyclone airflow, the second foreign objects being smaller than the first foreign objects; an air intake hole formed in the second filtering chambers and through which air is introduced; a pair of air introduction guides extended outward from the air intake hole to guide a flow of air introduced into the second filtering chamber in a tangent direction of an inner surface of the second filtering chambers; and a chamber sealing member formed under the filtering chamber to seal an inner space thereof.

In a further another aspect of the present invention, there is provided a dust collection unit for a vacuum cleaner, including: a first filtering chamber; a plurality of second filtering chambers for filtering foreign objects by using cyclone airflow generated by air introduced from the first filtering chamber; and at least two air introduction guides extended outward from the second filtering chambers so as to guide air introduction into openings of the second filtering chambers.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
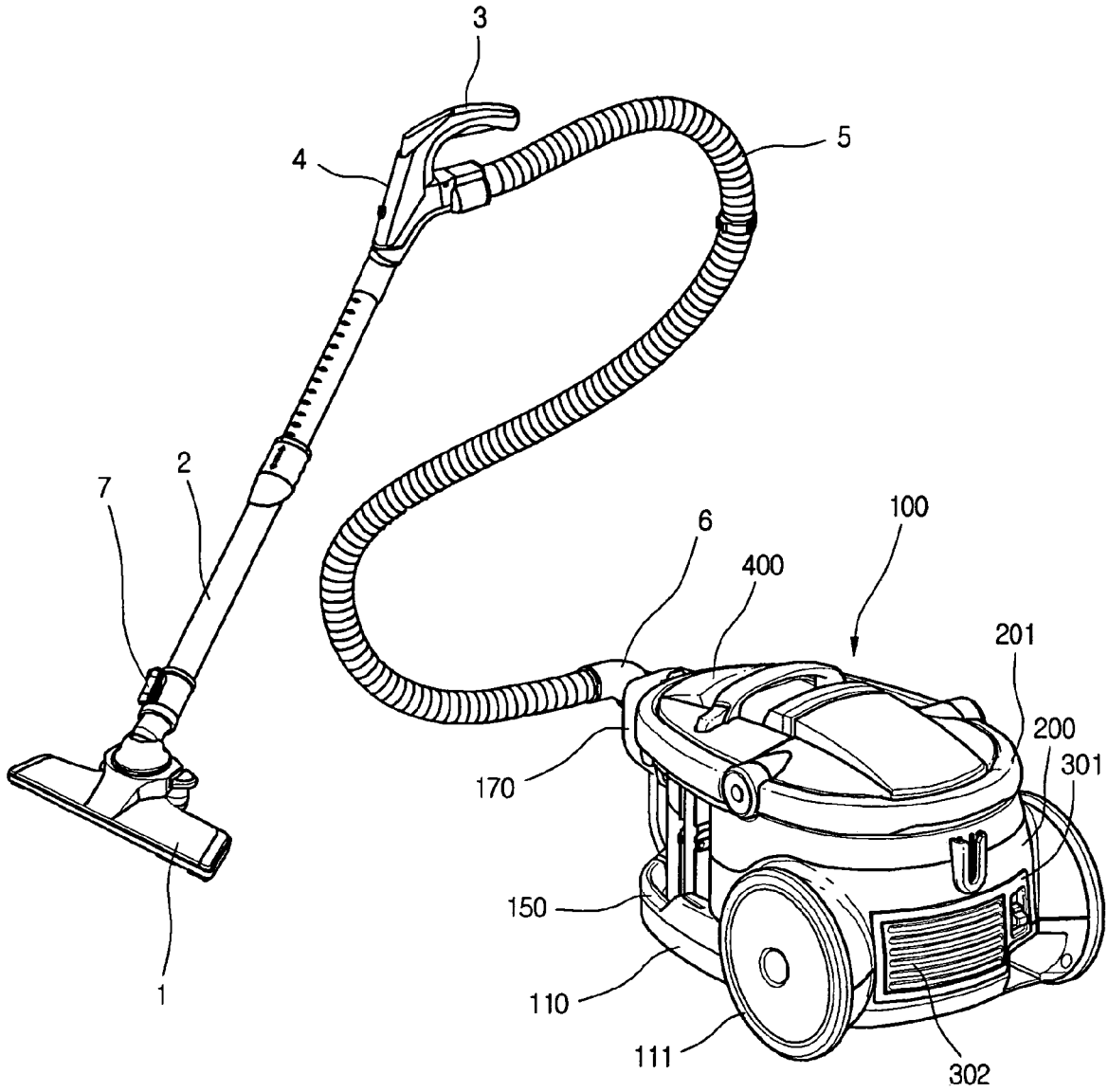
FIG. 1 is a perspective view of a vacuum cleaner where a dust collection unit of the present invention can be employed.

FIG. 1 is a perspective view of a vacuum cleaner according to the present invention.

Referring to FIG. 1, a vacuum cleaner includes a main body 100 and a suction assembly connected to a suction portion through which outer air is sucked into the main body 100. At least a suction fan (not shown) and a dust collection unit (not shown) are disposed in the main body 100 of the vacuum clear. Therefore, the sucked air is exhausted out of the main body 100 after foreign objects contained in the sucked air are filtered.

The suction assembly is provided to suck the air containing the foreign objects when sucking force is generated in the main body 100. That is, the suction assembly includes a sucking nozzle body 1 for sucking the air containing the foreign objects using a powerful airflow, an expandable tube 2 extending from the sucking nozzle body 1 and expandable and contractible by a user, an operation handle 3 provided on a distal end of the expandable tube 2, a manipulation unit 4 provided on a front portion of the operation handle 3, a flexible tube 5 extending from the operation handle 2, a connector 6 connecting a distal end of the flexible tube 5 to the main body 100, a pipe rest 7 on which the expandable pipe 2 can be supported and suspended when the vacuum cleaner is not used.

The connector 6 functions as a connection terminal transmitting a manipulation signal inputted by the user through the manipulation unit 4 to the main body 100 as well as a passage through which the sucked air is introduced into the main body 100. That is, a plurality of electric connection terminals are provided on a proximal end of the connector 6. Meanwhile, the electric connection terminals are required only when the manipulation unit 4 is provided on the suction assembly. That is, when the manipulation unit 4 is provided on the main body 100, the electric connection terminals are not provided on the connector 6. In this case, the connector 6 may simply function as an air introducing passage without the electric connection terminals.

The air introduced into the main body 100 through the suction assembly is exhausted out of the main body 100 after the foreign objects contained in the introduced air are filtered. The main body 100 of the vacuum cleaner will now be described in more detail with reference to FIGS. 1 and 2.

Figure 2:
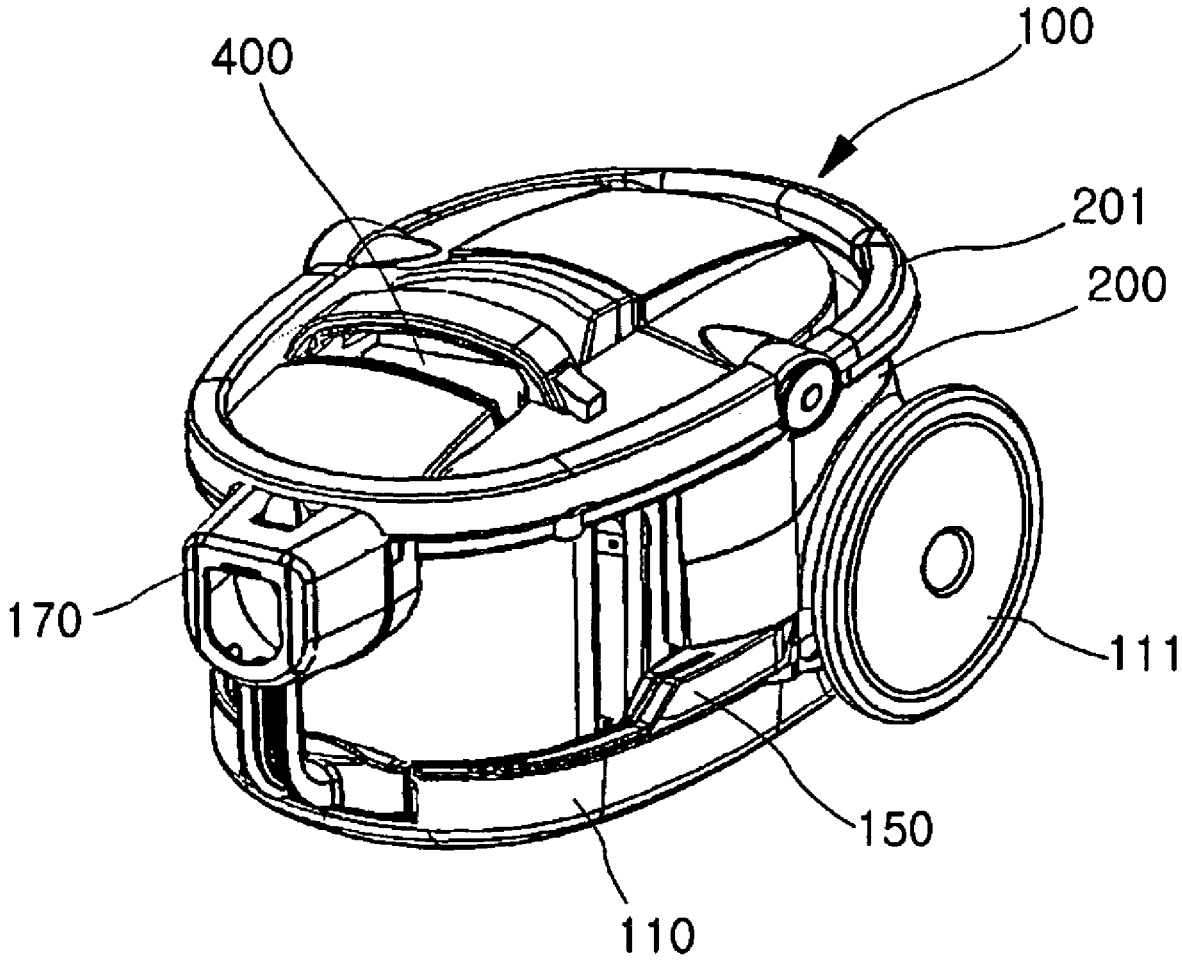
FIG. 2 is a front perspective of a vacuum cleaner depicted in FIG. 1.

FIG. 2 is a front perspective view of the main body of the vacuum cleaner.

Referring to FIGS. 1 and 2, the main body 100 includes a first base 110 defining a lower portion of the main body 100, a second base 150 disposed on the first base 110, a cover 200 disposed on the second base 150, wheels 111 provided on both rear-side portions of the cover 200 to make it easy to move the main body 100, and a front support 70 for supportedly fixing the cover 200 and the first and second bases 110 and 150.

The connector 6 is connected to the front support 170 to allow the outer air to be introduced into the main body 100. The support 170 is designed to support the cover 200 and the first and second bases 110 and 150, thereby securely supporting the front portion of the main body 100.

The second base 150 is provided right above the first base 110 to improve the ornament of the main body and enhance the rigidity of the lower portion of the main body.

An exhaust cover 301 provided with a plurality of exhaust holes 302 is provided on a rear portion of the cover 200 to exhaust clean air. A carrying handle 201 is pivotally provided on a top surface of the cover 200. When a user intends to carry the main body 100, the user pivots the carrying handle 201 in a vertical position and conveniently carries the main body 100 with his/her hand grasping the carrying handle 201.

A dust collection unit 400 is disposed in the main body in rear of the front support 170 and a cyclone member (not shown) is received in the dust collection unit to generate cyclone airflows and filter the foreign object contained in the air.

Figure 3:
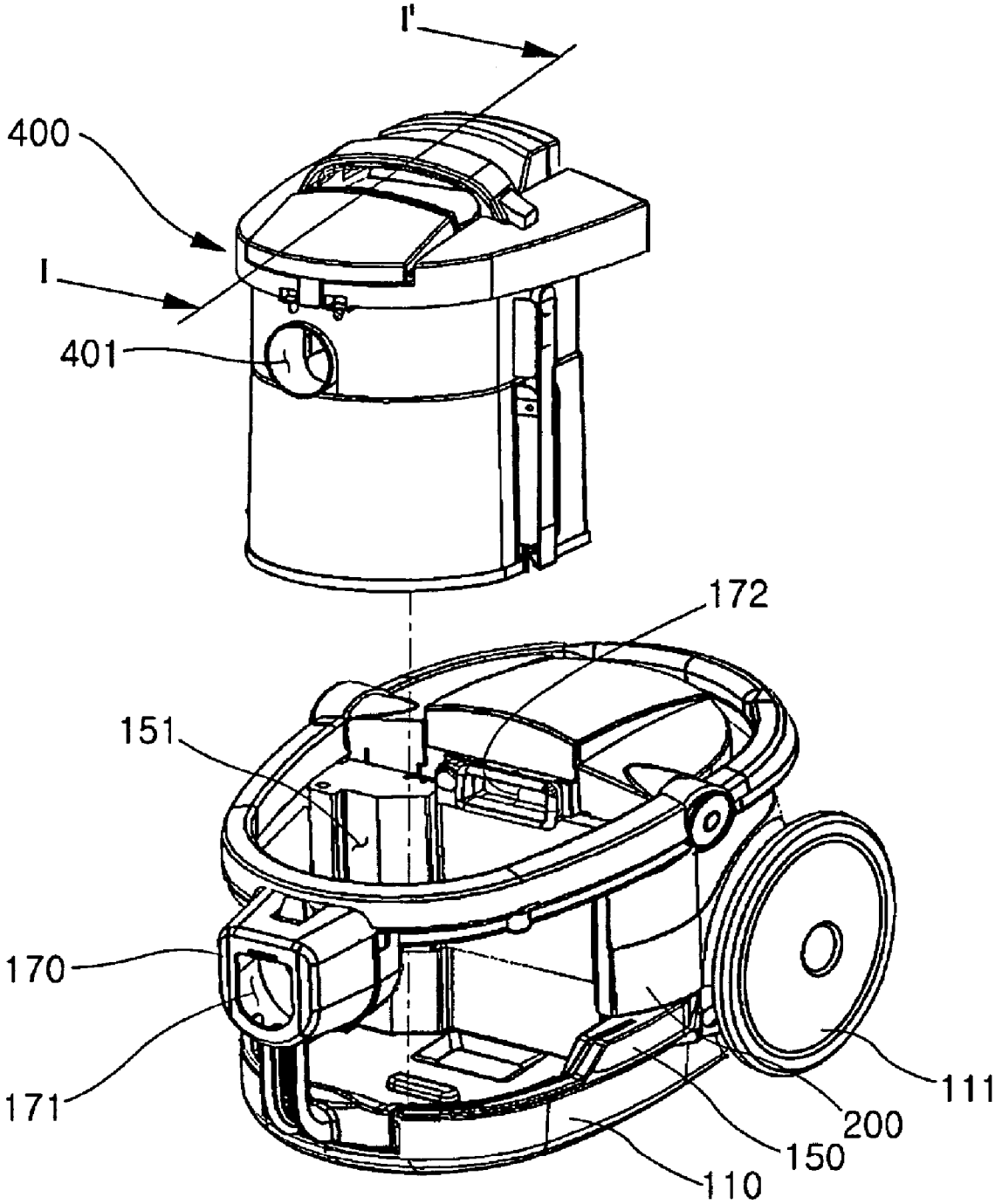
FIG. 3 is an exploded perspective view illustrating a dust, collection unit of a vacuum cleaner according to an embodiment of the present invention.

As shown in FIG. 3, the dust collection unit 400 is vertically installed in and separated from a receiving chamber 151 defined in the main body 100. That is, the dust collection unit 400 may be installed in the receiving chamber 151 by being pushed downward and separated from the receiving chamber 151 by being pulled upward.

The front support 170 is provided with a first air intake hole 171 and the dust collection unit 400 is provided with a second air intake hole 401 corresponding to the first air intake hole 171. The dust collection nit 400 is further provided with an exhaust hole (not shown) opposite to the second air intake hole 401. The exhaust hole is aligned with a third air intake hole 172 formed toward the motor so that the air cleaned by passing through the collection unit 400 is exhausted toward the motor side.

Particularly, the third air intake hole 172 is formed in a rectangular shape lengthwise in a horizontal direction so as to reduce the size of the main body 100 and allow the air to effectively flow.

Figure 4:
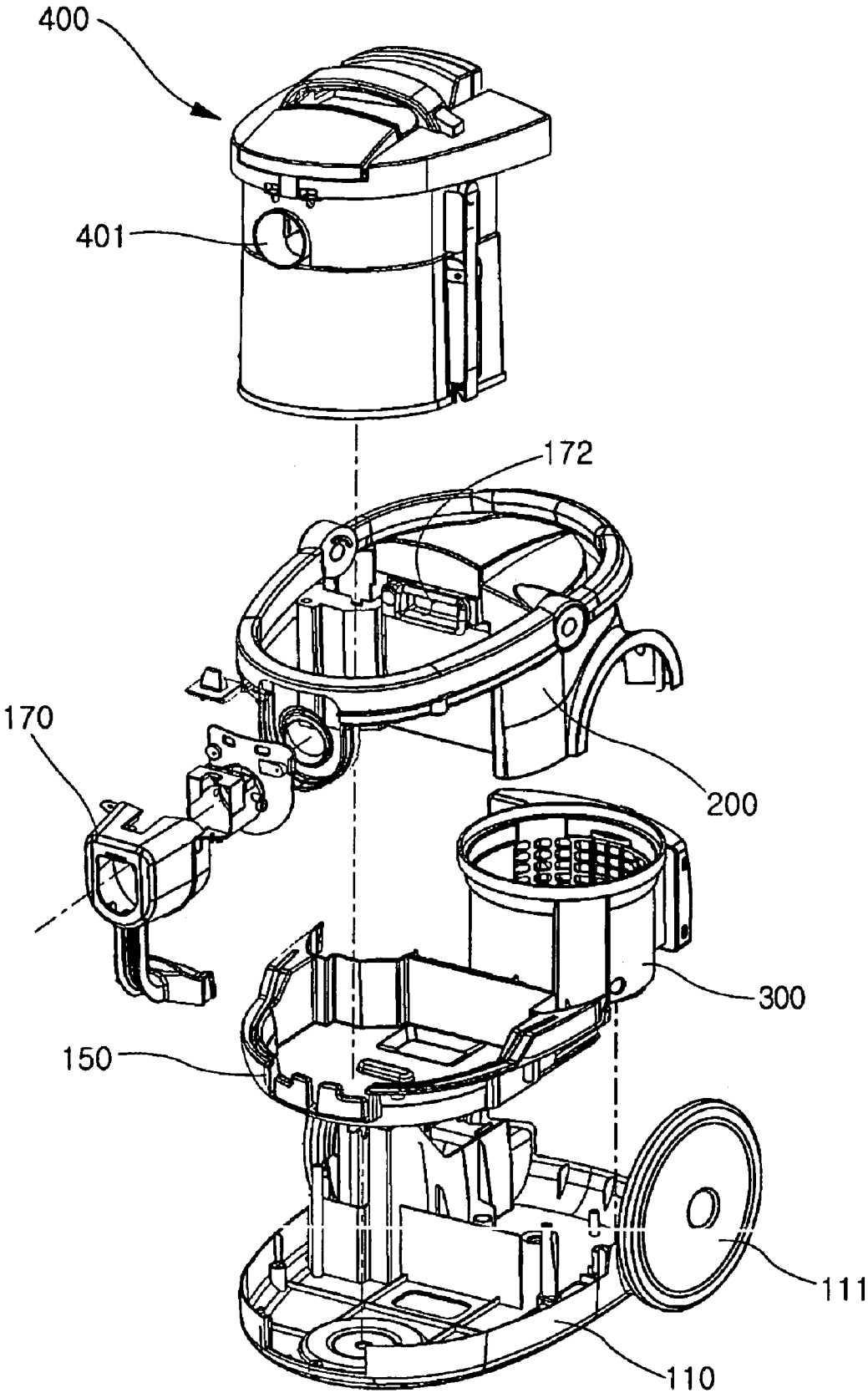
FIG. 4 is an exploded perspective view of a main body of a vacuum cleaner according to an embodiment of the present invention.

FIG. 4 shows the main body of the vacuum cleaner.

Referring to FIG. 4, the second base 150 is disposed on a rear-top portion of the first base 110. A motor housing 300 is disposed on a rear portion of the first base 110. Then, the cover 200 is sequentially coupled to the first and second bases 110 and 150 to define the main body 100.

Here, the cover 200 is coupled to the first and second bases 110 and 150 in a state where the front support 170 is coupled to the cover 200. A flowing direction of the air introduced into the motor housing 300 through the third air intake hole 172 is changed by 90° in a vertical direction and is then changed in a horizontal direction so that the air can be exhausted rearward.

Figure 5:
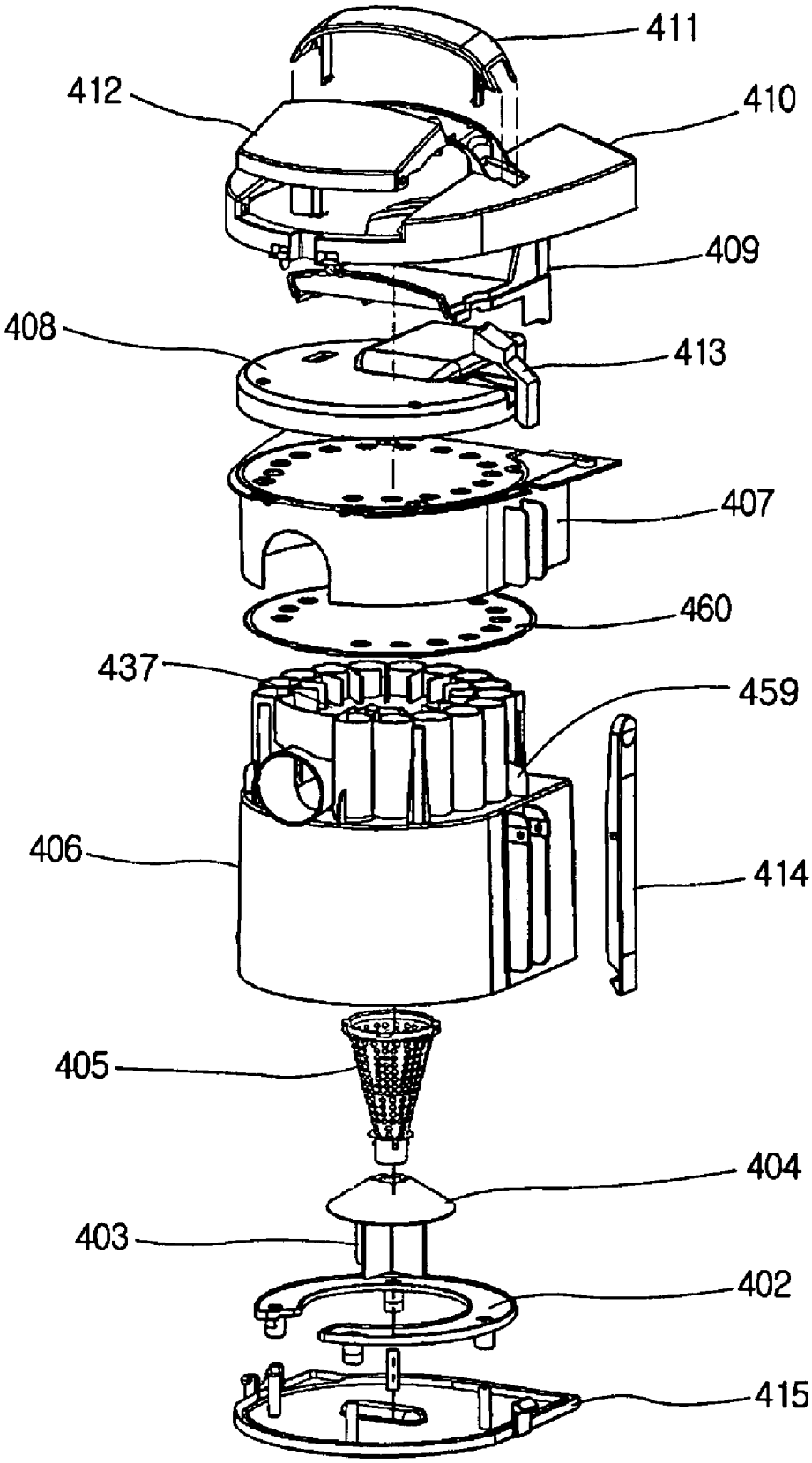
FIG. 5 is an exploded perspective view of a dust collection unit according to the present invention.

FIG. 5 is an exploded perspective view of the dust collection unit according to an embodiment of the present invention.

Referring to FIG. 5, the inventive dust collection unit 400 does not use a porous filter such as a sponge. That is, the inventive dust collection unit 400 is designed to filter the foreign objects using cyclone airflows. The cyclone airflow is generated at least two chambers separated from each other so that even the micro-scale dusts contained in the air can be filtered. This will be described in more detail hereinafter.

The dust collection unit 400 includes a collection body 406 provided with a plurality of filtering chambers (refer to the reference numerals 423 and 424 of FIG. 7) and a plurality of storing chambers (refer to the reference numerals 417 and 416 of FIG. 7), chamber sealing members 402 and 415 provided to seal a bottom of the collection body 406 and prevent the foreign objects stored in the storing chambers 416 and 417 from leaking, an air exhaust member 407 disposed on the collection body 406 to guide the flow of the air exhausted from the collection body 406, a gap forming member 408 providing a predetermined gap above the exhaust member 407 to allow the air exhausted from the exhaust member 407 to flow in a direction, and a cover assembly disposed on the gap forming member 408.

The cover assembly includes a first cover 410 functioning as a main body of the cover assembly, second and third covers 409 and 412 respectively disposed in rear and front of the first cover 410, a cover fixing member 411 fixing the first and second covers 410 and 409. The cover fixing member 411 is designed to cover a portion of the first cover 410 to improve the outer appearance while simultaneously fixing the first and second covers 410 and 409.

Disposed in the dust collection boy 406 are a cone-shaped filter 405 and a blocking member 404 and airflow preventing plates 403. The cone-shaped filter 405 is provided to effectively filter the foreign objects when the cyclone airflows are generated. The blocking member 404 is disposed under the cone-shaped filter 405 to prevent the collected foreign objects from flying. The airflow preventing plates 403 are formed under the blocking member 404 to lower the airflow rate and to thereby allow the foreign objects to sink to the bottoms of the foreign object storing chambers. The airflow preventing plates 403 and the blocking member 404 may be integrally formed with each other while the cone-shaped filter 405 may be provided as a separated part.

In addition, an opening/closing button 413 is provided on the first cover 410 and an opening/closing lever 414 having a first end contacting the opening/closing button 413 to pivot when the opening/closing button 413 is pushed. The opening/closing lever 414 has a second end contacting the first chamber sealing member 415. Therefore, when the opening/closing lever 414 is pushed, the opening/closing lever 414 pivots around a predetermined hinge point. When the second end of the opening/closing lever 414 moves away from the first chamber sealing member 415, the first chamber sealing member 415 rotates around a hinge point by its self-gravity and the foreign objects collected in the storing chambers 416 and 417 settled by their self-gravities.

In addition, the chamber sealing members 415 and 402 are designed to respectively seal the bottoms of the foreign object storing chambers 415 and 416. The first chamber sealing member 415 is hinge-coupled to the collection body 406 so that it can be opened by a pivotal motion when it is intended to throw away the foreign objects stored in the first chamber sealing member 415. A separation plate 437 for separating the first and second filtering chambers 423 and 424 from each other and defining an air passage is provided on a top surface of the collection body 406.

A plurality of guide ribs 459 are formed on an outer circumference of the collection body 406 to guide the insertion of the exhaust member 407 around the collection body 406. Each of the guide ribs 459 are gently rounded at an upper corner to effectively guide the insertion.

Figure 6:
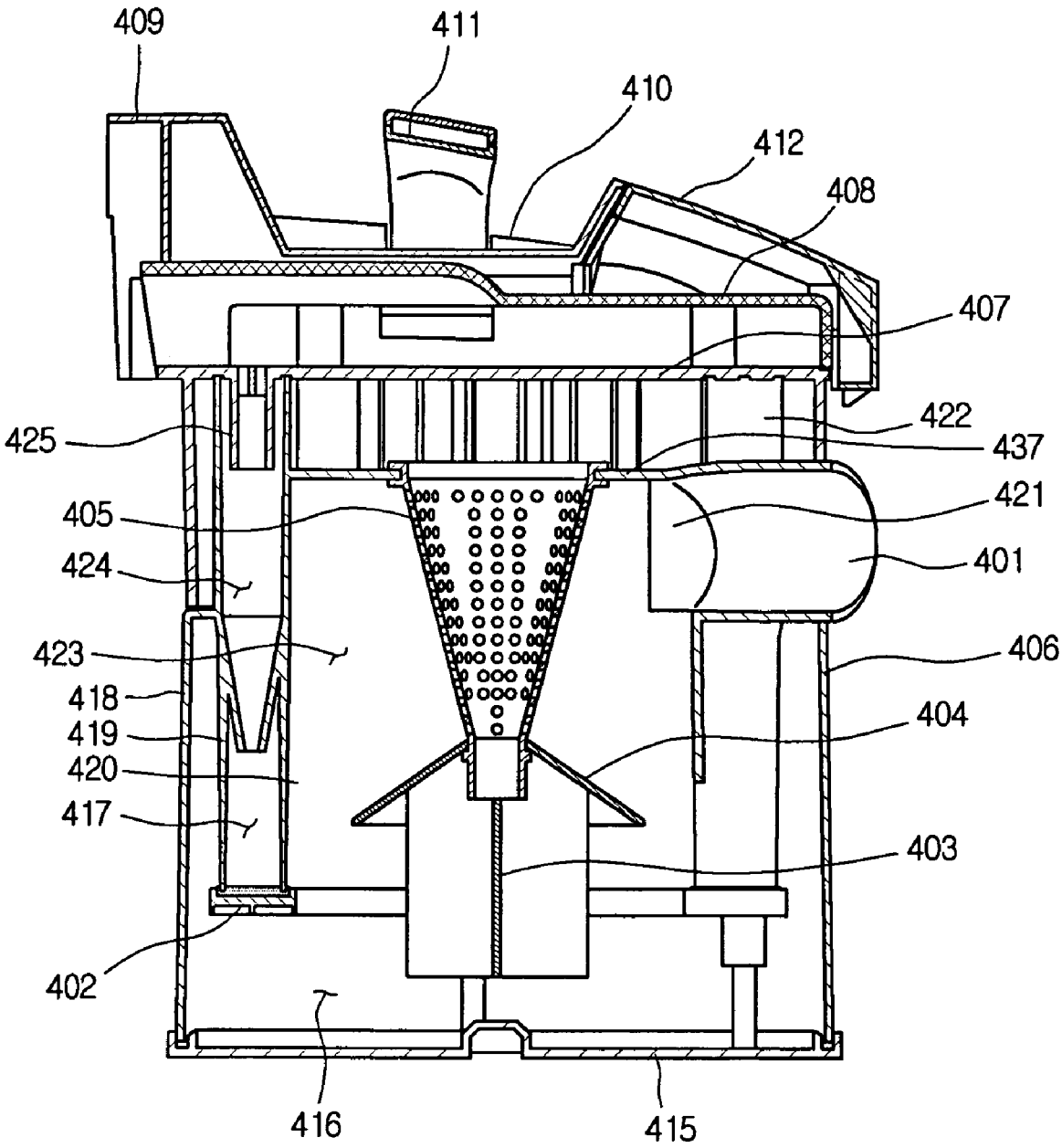
FIG. 6 is a sectional view taken along line I-I' in FIG. 3.

FIG. 6 is a sectional view taken along line I-I' in FIG. 3. The internal structure and operation of the dust collection unit 400 will be described in detail with reference to FIG. 6.

First, as described in detail in FIG. 5, the dust collection unit 400 includes the collection unit body 406, the chamber sealing members 402 and 415 provided to selectively seal the bottom of the collection body 406, the cone-shape filter 405 received in the collection body 406 to enhance the dust collection efficiency, the blocking member 404 preventing the foreign objects stored in the collection body 406 from flying, the airflow preventing plates 403 for lowering the airflow rate and for thereby allowing the foreign objects to sink to the bottoms of the foreign object storing chambers, the air exhaust member 407 disposed on the collection body 406 to guide the flow of the air exhausted from the collection body 406, the gap forming member 408 providing a predetermined gap above the exhaust member 407 to allow the air exhausted from the exhaust member 407 to flow in a direction, and covers 409, 410, 411, and 412 disposed on the gap forming member 408.

The structure of the collection body 406 will now be described.

The collection body 406 includes the outer wall 418 formed at the outermost portion, the intermediate wall 419 formed inside the outer wall 418, and the inner wall 420 formed inside the intermediate wall 419. The intermediate wall 419 and the inner wall 420 are not formed on the portion where the second air intake hole 401 is formed, thereby allowing the air to be effectively introduced.

A space defined between the outer wall 418 and the intermediate wall 419 becomes the first storing chamber 416 and a space defined between the intermediate wall 419 and the inner wall 420 becomes the second storing chamber 417. An inner space defined by the inner wall 420 becomes the first filtering chamber 423. However, the functions of the spaces vary according to the shape of the dust correction unit 400.

The operation of the above-described dust collection unit will be described hereinafter with reference to the airflow.

The air is first introduced into the dust collection unit 400 through the second air intake hole 401. Here, an outer end of the second air intake hole 401 communicates with the front support 170 and an inner end of the second air intake hole 401 communicates with the first filtering chamber 423. A first air introduction guide 421 is projected inward from a portion of the inner wall 420 to guide the air in an inner circumferential direction of the first filtering chamber 423.

When the cyclone airflow is generated in the first filtering chamber 423, the foreign objects contained in the air are settled and the cleaned air is exhausted upward through pores of the cone-shaped filter 405. The second air exhaust hole 401 is formed corresponding to an upper portion of the cone-shaped filter 405, a relatively high RPM cyclone airflow is generated at the upper portion of the cone-shaped filter 405 and a relatively low RPM cyclone airflow is generated at a lower portion of the cone-shaped filter 405. This is the reason for forming the filter 405 in the cone-shape. That is, since a large amount of the foreign objects are forced outward in the relatively high RPM cyclone airflow and a large amount of the foreign objects are forced in the relatively low RPM cyclone airflow, it is preferable that the filter 405 is formed in the cone-shape.

The cone-shaped filter 405 may be detachably seated on a center of the separation plate 437 defining a top wall of the first filtering chamber 423. The cone-shaped filter 405 is typically provided with a plurality of pores through which the air passes.

The blocking member 404 is disposed under the cone-shaped filter 405 to prevent the settled foreign objects from flying. The blocking member 404 has a diameter that is increased as it goes downward to prevent the foreign objects from flying in a reverse direction. The airflow preventing plates are disposed under the blocking member 404 at a predetermined gap to prevent the cyclone airflow form reaching the settled foreign objects, thereby basically preventing the settled foreign objects from flying.

The foreign objects filtered in the first filtering chamber 423 are stored in the first storing chamber 416 formed under the first filtering chamber 423. A bottom of the first storing chamber 416 is sealed by the first sealing member 415.

Relatively large-sized foreign objects are roughly filtered while the air passes through the cone-shaped filter 405 and is introduced from the upper portion of the separation plate 437. Therefore, in order to filter micro-scale foreign objects, additional cyclone airflow is further required. This will be described in more detail hereinafter.

The air passing through the cone-shaped filter 405 is introduced into the second filtering chambers 424 through a second air introduction guide 422. Since the second air introduction guide 422 faces the inner circumference of the second filtering chambers 424 in a tangent direction, the cyclone airflow is generated in the second filtering chamber 424.

Also, a third air introduction guide 482 is further formed at an outer portion of the second filtering chamber 424 together with the second air introduction guide 422 in order for allowing air to be introduced into the second filtering chamber 424. The third air introduction guide 482 allows air to be introduced into the second filtering chamber 424 more smoothly and prevents foreign objects from being lumped at the outer wall of the second filtering chamber 424.

In more detail, the third air introduction guide 482 extends from an outer wall of one second filtering chamber 424 toward an air intake hole of an adjacent another second filtering chamber 424. Therefore, the air introduced into the second filtering chamber 424 is guided by the second and second air introduction guides 422 and 482 and is introduced into the second filtering chamber 424. If the third air introduction guide is not provided, foreign objects are lumped at an intersection of the second filtering chamber 424 and the second air introduction guide 422 and thus are not exhausted, thereby causing user's displeasure.

Preferably, the second and third air introduction guides 422 and 482 can be extended from the outer wall of the second filtering chamber 424 in a tangent direction. Due to this construction, the air can be introduced into the second filtering chamber 424 more smoothly.

Preferably, one end of each of the second and third air introduction guides 422 and 482 is extended from the wall surface of the second filtering chamber 424 in a tangent direction, so that foreign objects can be introduced without any interrupt. The other ends of the air introduction guides 422 and 482 are tightly attached at one position such that the gap forming members are not protruded. Consequently, the space where foreign objects are lumped is removed. In other words, the other ends of the air introduction guides 422 and 482 are identical to each other. If the other ends of the air introduction guides 422 and 482 are disposed at different positions, unintended airflows occur at the periphery of the second filtering chamber 424. This airflow makes foreign objects lumped, resulting in bad outer appearance. Also, airflows are interrupted and collection efficiency is degraded.

Due to cyclone airflow, foreign objects are filtered from the air introduced into the second filtering chamber 424 and are settled and then stored in the second filtering chamber 417. In order to prevent the settle foreign objects from flying, a width of each of the lower portion of the second filtering chambers 417 are narrowed. In addition, in order to prevent the settled foreign objects from leaking, a bottom of the second storing chamber 417 is sealed by the second chamber sealing member 402.

The second chamber sealing member 402 has a bar-shaped connection structure to be connected to the first chamber sealing member 415, thereby increasing an inner volume of the first storing chamber 416. That is, since the foreign objects are stored in the space defined between the lower end of the second chamber sealing member 402 and the upper end of the first chamber sealing member 415, it is preferable that the connection structure is formed in a bar-shape that can occupy a small space.

The air whose foreign objects are filtered in the second filtering chamber 424 is introduced into the exhaust member 407 via an exhaust side air intake hole 425 and collected in a space between the exhaust member 407 and the gap forming member 408. Here, a diameter of the exhaust side air intake hole 425 is less than an inner diameter of the second filtering chamber 424 so as to prevent the foreign objects in the second filtering chamber 424 from being directed to the exhaust member 407. That is, the foreign objects collected on the inner circumference of the second filtering chambers 424 are not exhausted through the exhaust side air intake hole 425.

The air whose foreign objects are filtered in the first and second filtering chambers 423 and 424 by the cyclone airflows is directed to the motor and then exhausted through the rear surface of the main body 100.

Meanwhile, the cover assembly is further formed on an upper portion of the gap forming member 408. The cover assembly includes the first cover 410, the second and third covers 409 and 412 covering the rear and front portions of the fist cover 410, and the cover fixing member 411 fixing the second cover 409 to the first cover 410.

Hereinafter, the operation of guiding air introduced into the second filtering chamber 424 by using the second and third air introduction guides 422 and 482 will be described in detail.

Figure 7:
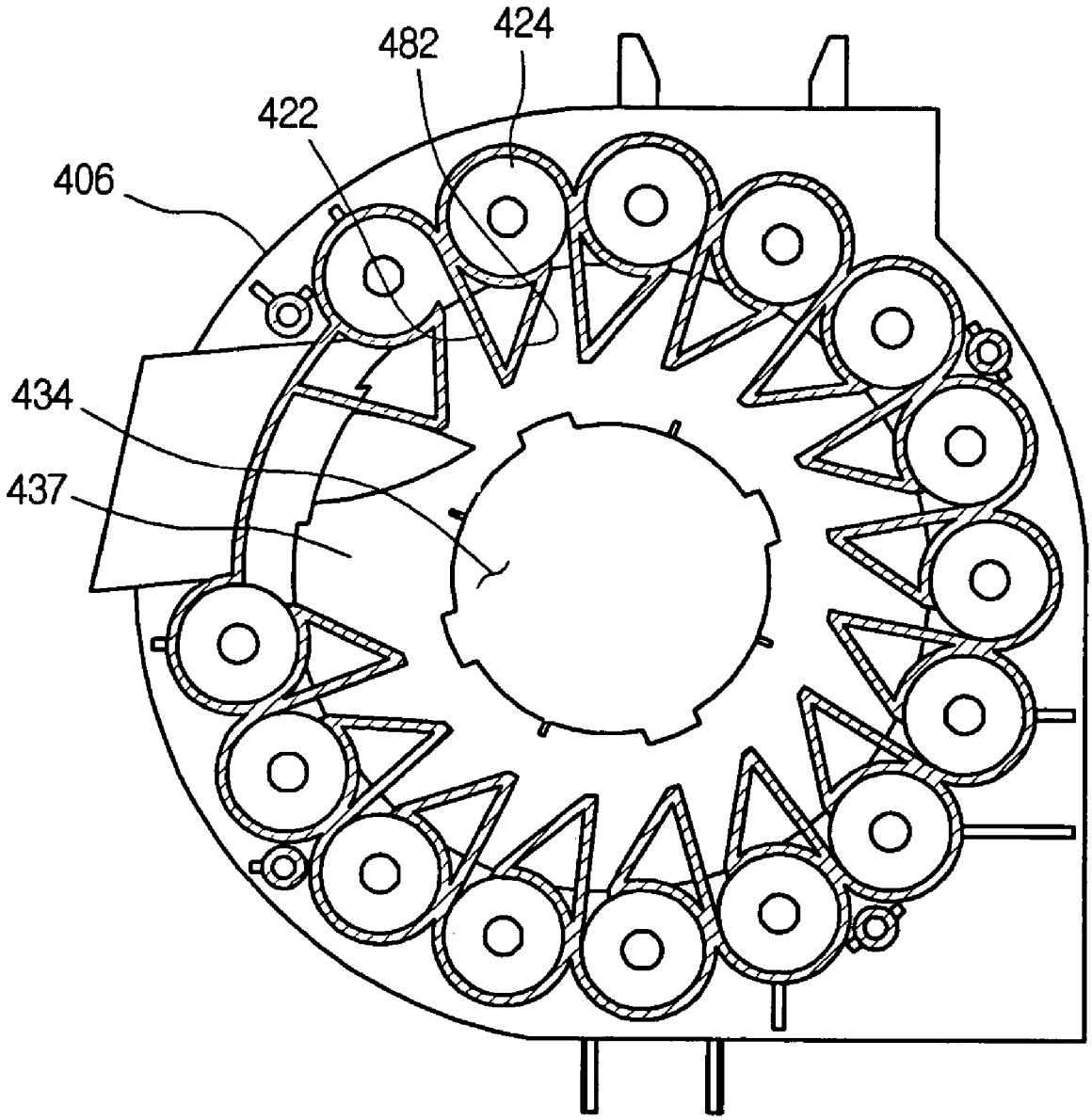
FIG. 7 is a sectional view taken along lines II-II' of FIG. 5.

FIG. 7 is a sectional view taken along II-II' in FIG. 5.

Referring to FIG. 7, air introduced into the filtering chamber can be guided more smoothly. Thus, the present invention can improve the collection efficiency and prevent foreign objects from being lumped.

For this purpose, the second and third air introduction guides 422 and 482 are extended in a tangent direction of the second filtering chamber 424 at both sides of the opening provided at a predetermined position of the second filtering chamber 424. Therefore, air flowing upward through the communication hole 434 can be smoothly introduced into the second filtering chamber 424. Since the airflow resistance is reduced, the suction efficiency can be improved and noise can be reduced.

Also, since the second and third air introduction guides 422 and 482 are in contact with each other such that no gaps exist, the air cannot be introduced into the space between the air introduction guides 422 and 482. Consequently, the foreign objects are not lumped and the collection efficiency is not degraded. Also, the outer appearance does not become dirty.

Figure 8:
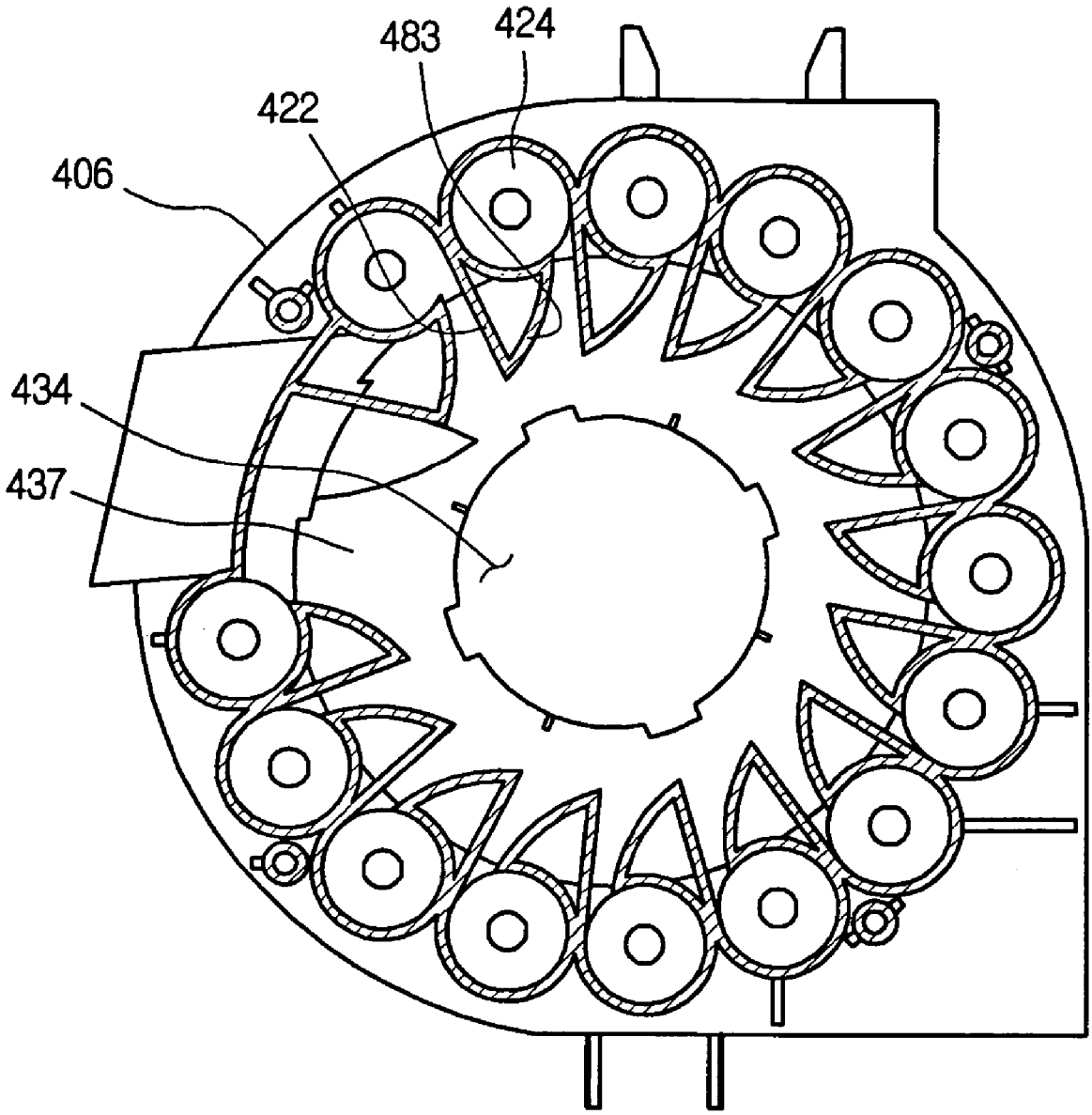
FIG. 8 is a sectional view of a fluid pressure guide according to another embodiment of the present invention.

FIG. 8 is a sectional view of an air introduction guide according to another embodiment of the present invention. In this embodiment, the third air introduction guide 482 is curved. In other words, the original function of the second and third air introduction guides 422 and 482 are to allow the air introduction into the second filtering chamber 424. The opening of the second filtering chamber 424 is curved.

The operation of the above-described dust collection unit 400 and the overall operation of the main body 100 of the vacuum cleaner will be described hereinafter with reference to FIG. 9.

Figure 9:
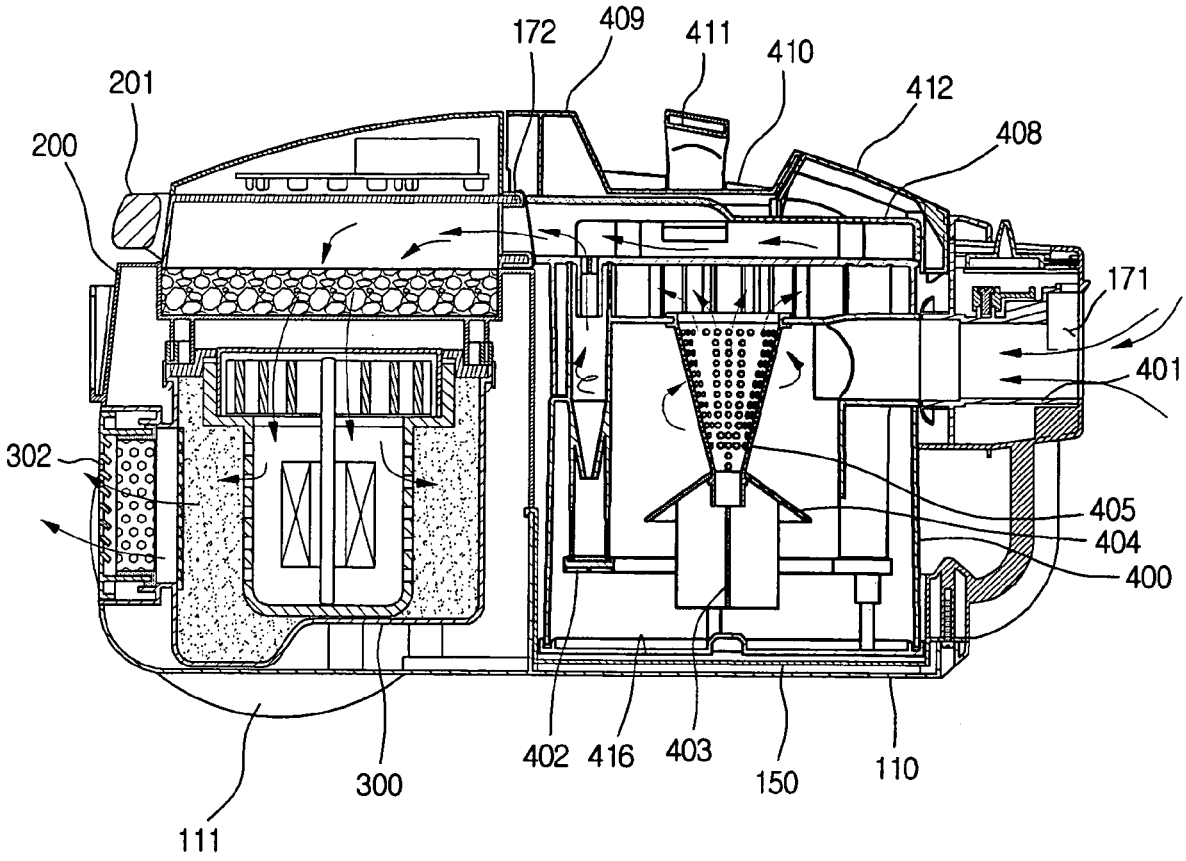
FIG. 9 is a cross-sectional view of a vacuum cleaner according to the present invention.

Referring to FIG. 9, outer air is introduced into the main body 100 through the air intake hole 171 of the main body, which is connected to the connector 6, and is then introduced into the dust collection unit 400 through the air intake hole 401 of the dust collection unit. The foreign objects contained in the air is filtered in the dust collection unit 400 as described above and is then introduced into the motor housing 300 through the air intake hole 172 of the motor side.

When the motor housing 300 stands vertically, the air intake hole is directed upward. Thus, the air introduced through the collection unit 400 in the horizontal direction moves downward to be exhausted through the exhaust holes 302 formed on the rear surface of the main body 100.

It will be apparent to those skilled in the art that various modifications and variations can be made in the present invention. Thus, it is intended that the present invention covers the modifications and variations of this invention provided they come within the scope of the appended claims and their equivalents.

According to the present invention, air can be smoothly introduced into the second filtering chamber having a small aperture.

In such a structure, the interior of the collection unit can be kept cleaner. Also, since the airflow resistance in the collection unit is reduced, the collection efficiency can be improved.

In addition, since the air friction in the collection unit is reduced, noise can be decreased.

What is claimed is:

1. A dust collection unit for a vacuum cleaner, comprising:

a first filtering chamber for filtering first foreign objects;

a plurality of second filtering chambers formed along an outer circumference of the first filtering chamber to receive air passed through the first filtering chamber and filter second foreign objects by using cyclone airflow, the second foreign objects being smaller than the first foreign objects;

an air intake hole through which air is introduced into the second filtering chambers;

at least two air introduction guides extended outward from the air intake hole to guide a flow of air introduced into the second filtering chamber; and a storing chamber formed under the filtering chamber.

2. The dust collection unit according to claim 1, wherein the second filtering chambers substantially surround an entire circumference of the first filtering chamber.

3. The dust collection unit according to claim 1, wherein the air introduction guide is extended from the second filtering chambers in a tangent direction.

4. The dust collection unit according to claim 1, further comprising a separation plate defining a top wall of the first filtering chamber, the separation plate having a communication hole through which the air filtered in the first filtering chamber is exhausted.

5. The dust collection unit according to claim 4, wherein the air introduction guide is formed on an upper side of the separation plate.

6. The dust collection unit according to claim 1, wherein two air introduction guides are formed with respect to the second filtering chambers and a gap between the two air introduction guides are narrower toward the air intake hole.

7. The dust collection unit according to claim 1, wherein one of the air introduction guides of one of the plurality of second filtering chambers is met with a second air introduction guide of another of the plurality of second filtering chambers adjacent thereto.

8. The dust collection unit according to claim 1, wherein a pair of the air introduction guides has the same end portion.

9. The dust collection unit according to claim 1, wherein one of the air introduction guides is rounded.

10. The dust collection unit according to claim 9, wherein the air introduction guide is convex.

11. The dust collection unit according to claim 1, wherein the filtering chamber is extended vertically and air is introduced from a side of the filtering chamber and is exhausted upward.

12. A dust collection unit for a vacuum cleaner, comprising:

a first filtering chamber for filtering a first foreign objects;

a plurality of second filtering chambers formed along an outer circumference of the first filtering chamber to receive air passed through the first filtering chamber and filter a second foreign objects by using cyclone airflow, the second foreign objects being smaller than the first foreign objects;

an air intake hole formed in the second filtering chambers and through which air is introduced;

a pair of air introduction guides extended outward from the air intake hole to guide a flow of air introduced into the second filtering chamber in a tangent direction of an inner surface of the second filtering chambers; and a chamber sealing member formed under the filtering chamber to seal an inner space thereof.

13. The dust collection unit according to claim 12, wherein one of the pair of the air introduction guides is met with an air introduction guide of another second filtering chamber adjacent thereto.

14. The dust collection unit according to claim 13, wherein a position where the air introduction guides is met is an end of each of the air introduction guides.

15. The dust collection unit according to claim 12, wherein the air introduction guides are curved.

16. The dust collection unit according to claim 12, wherein the pair of air introduction guides and one of the plurality of second filtering chambers form a closed section.

17. The dust collection unit according to claim 12, wherein one of the air introduction guides is straight and the other thereof is curved.

18. A dust collection unit for a vacuum cleaner, comprising:

a first filtering chamber;

a plurality of second filtering chambers for filtering foreign objects by using cyclone airflow generated by air introduced from the first filtering chamber; and at least two air introduction guides extended outward from the second filtering chambers so as to guide air introduction into openings of the second filtering chambers.

19. The dust collection unit according to claim 18, wherein one of the air introduction guide is curved and the other thereof is straight.

20. The dust collection unit according to claim 18, wherein one of the air introduction guides has an end shared with an air introduction guide of an adjacent second filtering chamber.

* * * * *